US006463859B1

(12) United States Patent
Ikezawa et al.

(10) Patent No.: US 6,463,859 B1
(45) Date of Patent: Oct. 15, 2002

(54) GAME MACHINE SYSTEM

(75) Inventors: Mamoru Ikezawa; Tetsuo Tsuchiya; Tatsuya Yamazaki, all of Tokyo (JP)

(73) Assignee: Namco Limited, Tokyo (JP)

( * ) Notice: Subject to any disclaimer, the term of this patent is extended or adjusted under 35 U.S.C. 154(b) by 0 days.

(21) Appl. No.: 09/703,672

(22) Filed: Nov. 2, 2000

(30) Foreign Application Priority Data

Nov. 10, 1999 (JP) ..... 11-319332

(51) Int. Cl.[7] ..... A63H 11/00

(52) U.S. Cl. ..... 104/53; 463/52; 463/7; 463/53

(58) Field of Search ..... 104/53, 59, 77, 104/83; 472/43, 117; 463/52, 38, 50, 7, 53; 273/440, 459

(56) References Cited

U.S. PATENT DOCUMENTS

| | | | | |
|---|---|---|---|---|
| 1,555,028 A | * | 9/1925 | Roth | 104/60 |
| 4,767,117 A | * | 8/1988 | Maio | 273/352 |
| 5,785,592 A | * | 7/1998 | Jacobsen | 463/7 |
| 6,220,965 B1 | * | 4/2001 | Hanna et al. | 463/52 |

* cited by examiner

*Primary Examiner*—S. Joseph Morano
*Assistant Examiner*—Frantz F. Jules
(74) *Attorney, Agent, or Firm*—Burns, Doane, Swecker & Mathis, LLP

(57) ABSTRACT

A riding type game machine system includes a vehicle movable along a path with a player riding therein and a plurality of game stages arranged along the path. At least one of the game stages is adapted to perform a contact type game having an input operation performed by the player touching a target. The contact type game is, for example, a target hitting game, which is a familiar game for the player compared with a non-contact type game such as a shooting game using infrared ray.

14 Claims, 3 Drawing Sheets

GAME MACHINE SYSTEM

BACKGROUND OF THE INVENTION

1. Field of the Invention

The present invention relates to a game machine system in which a player riding on a vehicle plays a plurality of games.

2. Description of the Related Art

The so-called riding type game machine in which a player riding on a vehicle performs a game has been known. In the riding type game machine, it is usual that the player plays a non-contact type game such as, for example, a shooting game in which the player shoots a target with a model gun using infrared ray.

On the other hand, the so-called hitting type game machine in which a player hits a target with a hammer has been also known. In this game machine, the player scores when he exactly hits the target.

In the riding type game machine, since the player plays a game without physical contact therewith, there is a problem that it is impossible to perform the game with familiarity therewith. Further, in the hitting type game machine, since the player always hits the same target, there is a problem that the player tends to be tired of the game.

SUMMARY OF THE INVENTION

The present invention was made in view of the problems of the conventional game machines and an object of the present invention is to provide a riding type game machine system with which a player can play a familiar game.

In order to achieve the above object, a game machine system according to the present invention comprises a vehicle, which is movable along a path with a player riding thereon, and a plurality of game stages arranged along the path, wherein, in at least one of the game stages, the player plays a contact type game in which the player scores when he contacts with a target.

According to the game machine system constructed as mentioned above, it is possible to provide various games to the player by the employment of the riding type game machine. Further, since the games to be played by the riding type game machine include a contact type game partially, the player can enjoy friendly and approachable games.

In the game machine system constructed as mentioned above, the behavior of the player that he contacts with a target may include to hit the target with a hand or a hitting member such as hammer, to push a button as a target or to pat the target, etc. Further, the behavior of success may include hitting a bad target and patting a good target.

Among the above mentioned various behaviors, the behavior of hitting a target is most natural and easiest way to join a game for the player playing the game while riding on a vehicle.

The game machine system having the construction mentioned above may further comprise operation means for totalizing scores in the game stages. According to such construction, it is possible to show a total score of a player to him after a plurality of different kinds of game is over to thereby provide games to him, which is more enjoyable game compared with a case where the player plays games in respective game machines.

In the game machine system according to the present invention, it is possible to provide a branch point in the rail and to determine a moving direction of the vehicle according to a score obtained in a game stage on an upstream of the branch point. With this construction, it is possible to provide different kinds of game to a player according to the score he obtained to thereby provide various games to the player corresponding to his capability.

BRIEF DESCRIPTION OF THE DRAWINGS

The above mentioned and other objects, features and advantages of the present invention will become more apparent by reference to the following detailed description of the invention taken in conjunction with the accompanying drawings, in which.

DETAILED DESCRIPTION OF THE PREFERRED EMBODIMENTS

Figure 1:
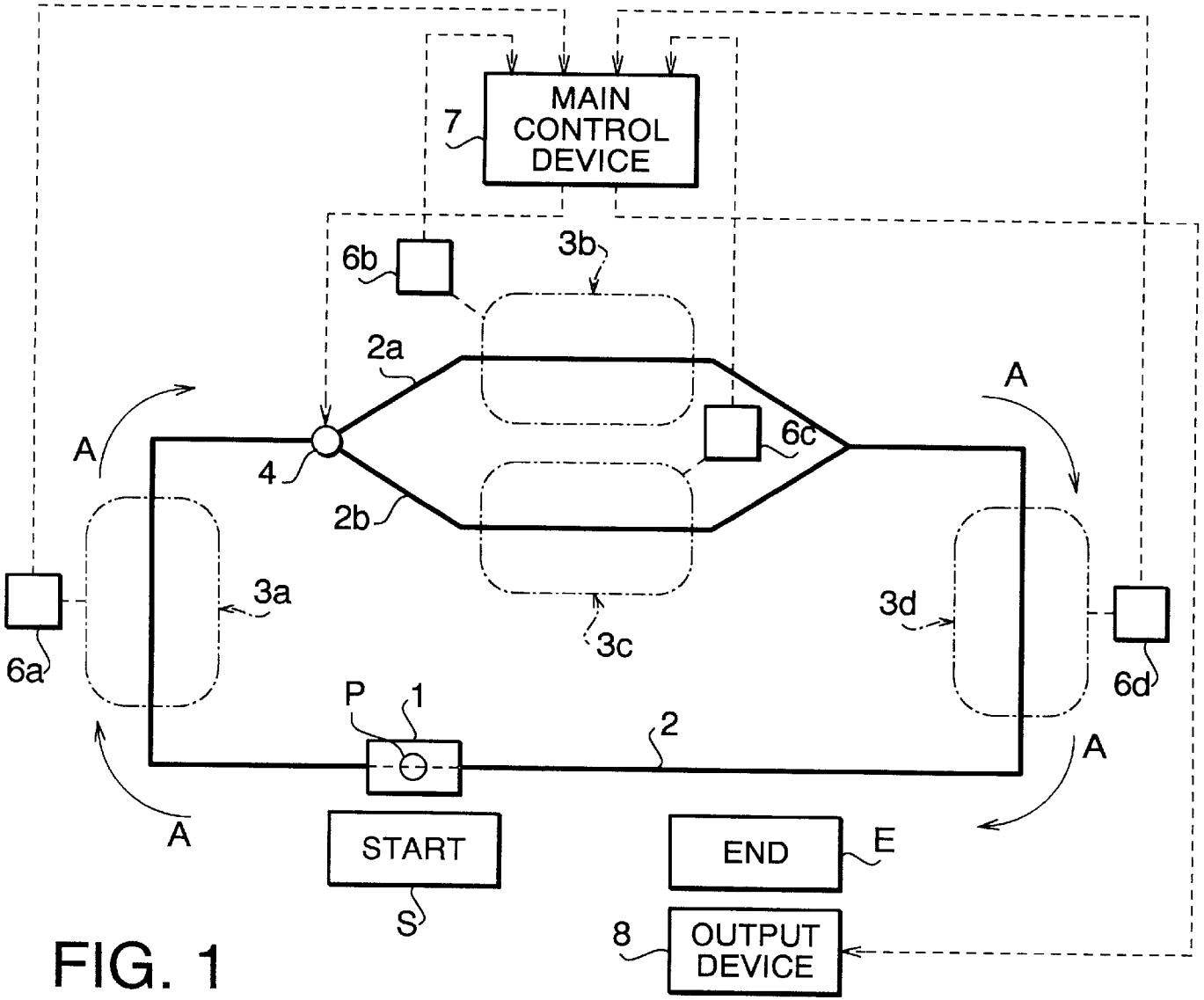
FIG. 1 is a plan view of an embodiment of a game machine system according to the present invention.

FIG. 1 shows an embodiment of a game machine system according to the present invention. The game machine system comprises a vehicle 1 on which a player P rides, a rail 2 constituting a transportation path of the vehicle 1 and a plurality of game stages 3*a*, 3*b*, 3*c* and 3*d* arranged along the rail 2. The vehicle 1 may have any constructions, provided that it can move along the rail 2 with the player P riding thereon.

The vehicle 1 is movable from a start stage S to an end stage E along the rail 2 in a clockwise direction as shown by an arrow A, under control of a transportation control device, which is not shown. A branch point 4 of the rail 2 is provided in a downstream of the first stage 3*a* and branch rails 2*a* and 2*b* are provided in a downstream of the branch point 4 such that the branch rails 2*a* and 2*b* pass through the game stages 3*b* and 3*c*, respectively. After the branch rails 2*a* and 2*b* pass through the respective game stages 3*b* and 3*c*, they link up with the main rail 2.

Game control devices 6*a*, 6*b*, 6*c* and 6*d* are connected to the game stages 3*a* to 3*d*, respectively, and to input ports of a main control device 7, respectively. Each of the game control devices 6*a* to 6*d* is constituted with a CPU (Central Processing Unit) and a memory, each of which stores a game program of a corresponding one of the game stages 3*a* to 3*b*.

The main control device 7 is constituted with a CPU and a memory storing a program for executing a totalizing operation for totalizing results of the games performed by the player P in the respective game stages 3*a* to 3*d*. The totalizing operation may include addition and/or subtraction of game scores, etc.

A communication between the respective game control devices 6*a* to 6*d* and the main control device 7 may be established by a LAN (Local Area Network) through communication cables or wireless communications utilizing infrared rays.

The respective game control devices 6*a* to 6*d* provide different kinds of game to the player P riding on the vehicle 1 coming to the respective game stages 3*a* to 3*d*, according to the game programs stored in the memories belonging to the respective game stages. Further, the game control devices 6*a* to 6*d* belonging to the respective game stages 3*a* to 3*d* transmit results such as, for example, scores of the games performed by the player P in the game stages 3*a* to 3*d* to the main control device 7 as signals.

The branch point 4 provided in the rail 2 downstream of the first game stage 3*a* switches the moving direction of the vehicle 1 between the branch rails 2*a* and 2*b* according to an instruction from the main control device 7. A structure of the branch point 4 may be any, provided that it can switch the moving direction of the vehicle 1.

An output device 8 is provided in the end stage E, which is positioned at a final point of the movement of the vehicle 1 with the player P riding thereon. The output device 8 may be constituted with, for example, a video display such as a CRT display or a printer for printing information on a recording material such as a recording paper. The output device 8 is connected to the main control device 7 through a cable or a radio communication line to present a picture on a display and/or to present a hard copy by the printer based on data or video data transmitted from the main control device 7.

The games performed in the respective game stages 3*a* to 3*d* may be one and the same kind. However, in order to give the player P more enjoyable game, it is preferable to make the games to be performed in the respective game stages different kinds.

As to the kinds of game, it can be considered that there are a non-contact type game and a contact type game. A typical example of the non-contact type game is a shooting game in which a player shoots a target by means of an infrared ray emitter without direct contact of the player with the target. On the contrary, the contact type game is exemplified by the hitting game in which a player hits a target with his hand directly or with a member such as a hammer indirectly to score.

In the game machine system according to the present invention, the game performed in at least one, preferably, a plurality of the game stages 3*a* to 3*d* may be the contact type game.

Figure 2:
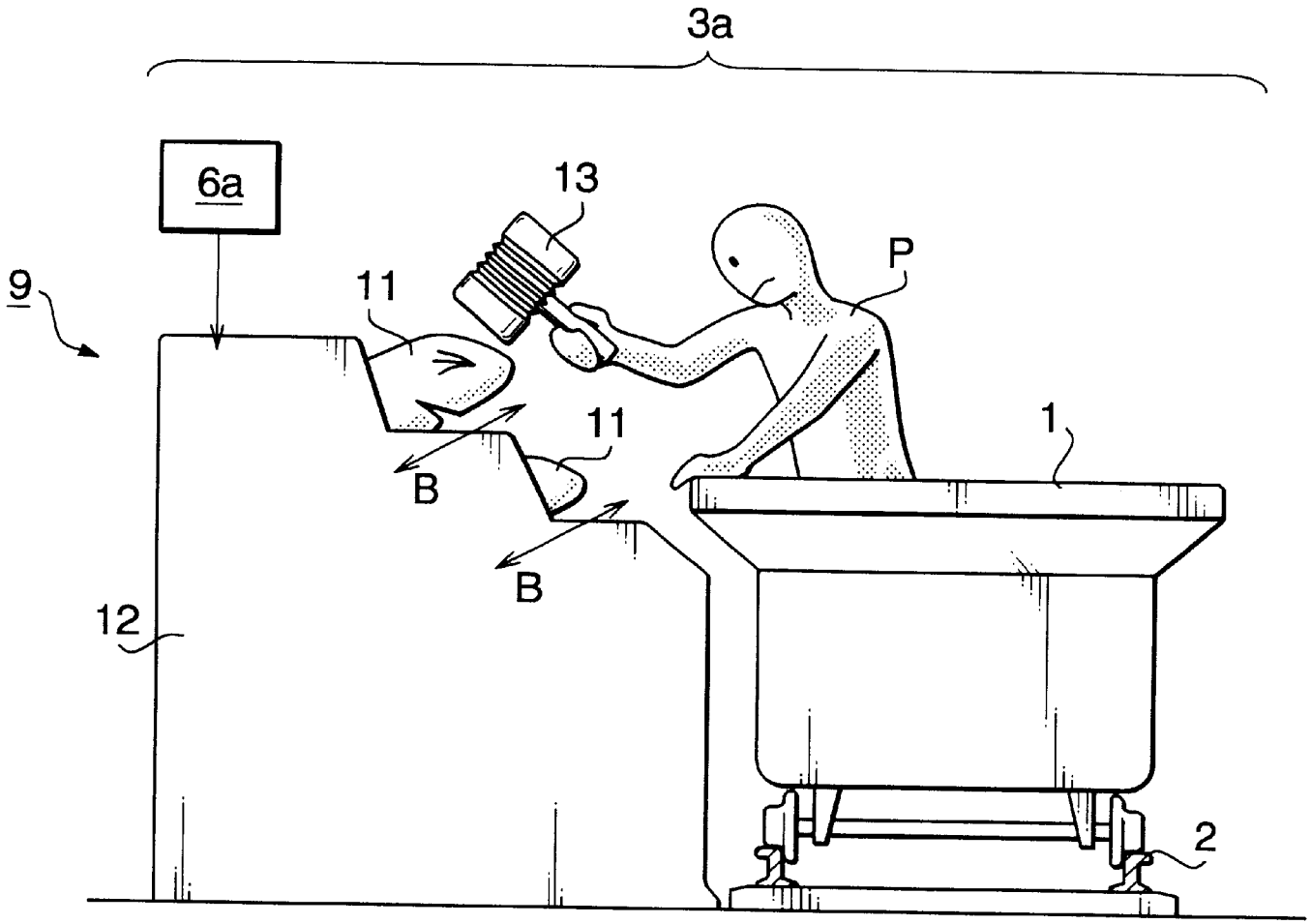
FIG. 2 is a front view of an example of a contact type game which is one of game stages contained in the game machine system shown in FIG. 1.

For example, a contact type game machine 9 such as shown in FIG. 2 is arranged in the first game stage 3*a*. The game machine 9 includes a plurality of targets 11 each having a shark head figure and a casing 12 housing these targets 11. Each target 11 can reciprocally move between a position in which the target 11 is hidden in the casing 12 and a position in which the target 11 is exposed through an opening formed in the casing 12 as shown by a double head arrow B. The targets 11 randomly protrude from and draw back to the casing 12 under control of the game control device 6*a*.

A mechanism for reciprocally moving the targets 11 may be constructed arbitrarily. For example, a link mechanism for converting a rotary movement from a motor into a linear movement or a mechanism using a rack for converting a rotary movement from a motor into a linear movement may be utilized.

Sensors such as micro switches or mechanical switches, etc., or other sensors for sensing vibration are provided in suitable positions of each target 11. When the player P riding on the vehicle 1 running along the rail 2 hits one or more of the targets 11 with a hitting tool 13 such as hammer, vibration generated thereby is sensed by one or more of the sensors to thereby detect the target 11 hit.

The game control device 6*a* belonging to the game machine 9 counts the hitting every time when the target 11 is hit with the hammer 13 and transmits the count to the main control device 7 shown in FIG. 1 as a result of the game.

Figure 3:
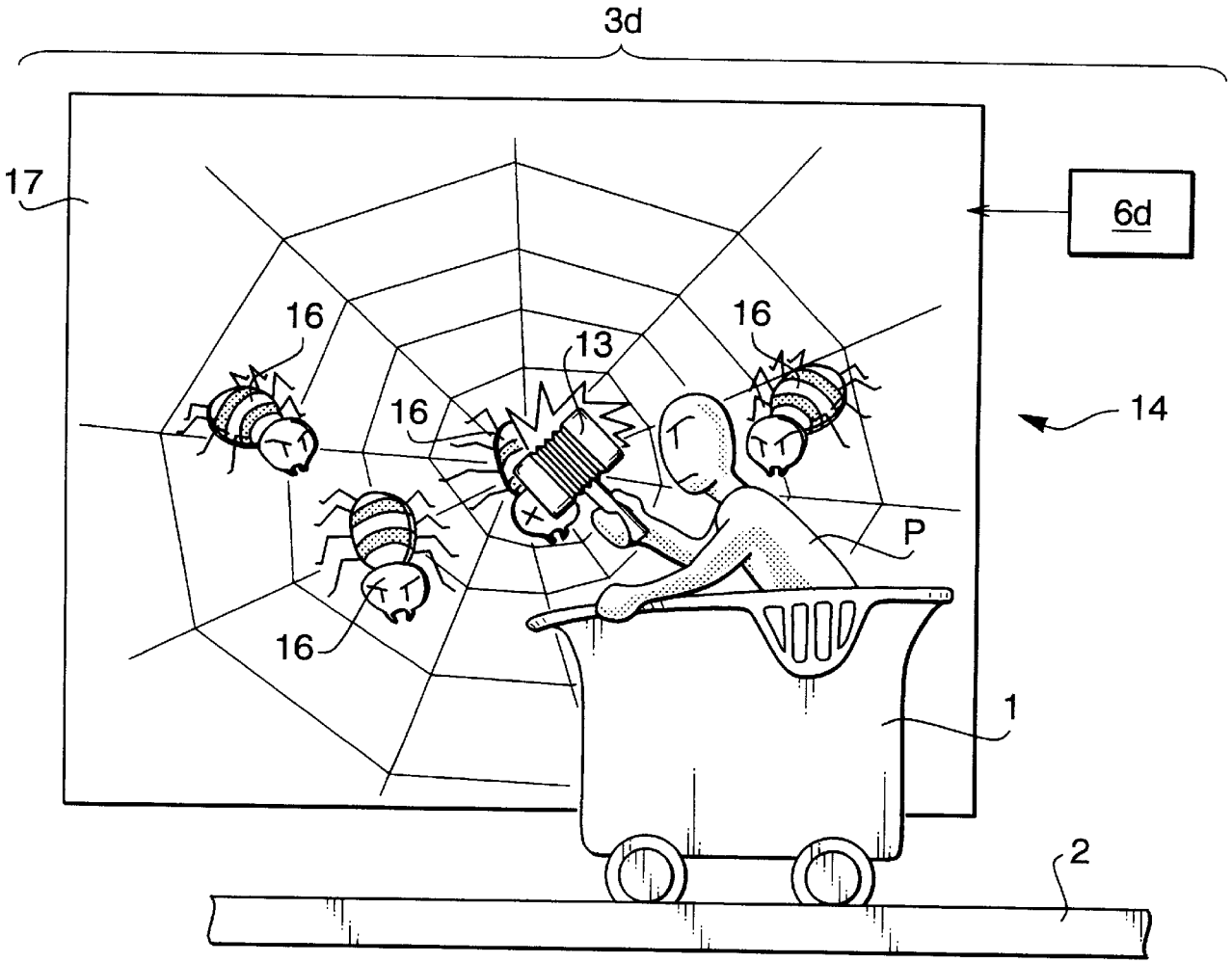
FIG. 3 is a front view of another example of a contact type game, which is one of game stages contained in the game machine system shown in FIG. 1.

In FIG. 1, a contact type game machine 14 shown in FIG. 3 is provided in the fourth game stage 3*d* arranged upstream of the end stage E. The game machine 14 includes a plurality of targets 16 in the form of a spider figure and a base plate 17 for supporting these targets 16. A cobweb is drawn on the base plate 17 and the targets 16 can move on a surface of the base plate 17.

The movement of each target 16 may be a simple linear reciprocation. However, in order to make the game more interesting for the player, it is preferable to set the moving path of each spider such that the latter can move through a different and complicated path on the base plate 17. A mechanism for moving each target along the complicated path may be constructed in various manners. For example, it is possible to provide a suitably patterned rail or groove on the base plate 17, support the target 16 movably along the rail or groove and move the target 16 by using a motor, etc., as a drive source.

A sensor such as micro switch or mechanical switch, etc., or other sensor for sensing vibration is provided in a suitable position of each target 16. When the player P riding on the vehicle 1 running along the rail 2 hits the target 16 with a hitting tool 13 such as hammer, vibration generated thereby is sensed by the sensor to thereby detect the target 16 hit.

The game control device 6*d* belonging to the game machine 14 counts the hitting every time when the target 16 is hit with the hammer 13 and transmits the count to the main control device 7 shown in FIG. 1 as a result of the game.

An operation of the game machine system constructed as mentioned above will be described.

In FIG. 1, the player P rides on the vehicle 1, which is standing by in the start stage S. The vehicle 1 moves along the rail 2 to the first game stage 3*a* in a direction shown by the arrow A. The player P arrived at the first game stage 3*a* performs a contact type game with respect to the game machine 9 by using the hammer 13 as shown in FIG. 2. In this game, the vehicle 1 may be stopped or moved at a usual speed or a speed lower than the usual speed.

A result of the game, that is, a score, is transmitted to the main control device 7 by the game control device 6*a* and stored in the memory of the main control device 7. The main control device 7 controls the branch point 4 according to the result of the game transmitted from the game control device 6*a* belonging to the first game stage 3*a* to select one of the branch rails 2*a* and 2*b* as a moving direction of the vehicle 1.

For example, the hardness of difficulty of a game to be performed in the second game stage 3*b* provided on the branch rail 2*a* may be set high and that of a game to be performed in the third game stage 3*c* provided on the branch 2*b* may be set low. In such case, when the result of game in the first game stage 3*a* is higher than a predetermined reference score, the main control device 7 controls the branch point 4 to select the branch rail 2*a* to thereby guide the player P to the second game stage 3*b* to force the player P to challenge the difficult game. On the other hand, when the result of game in the first game stage 3*a* is lower than the predetermined reference score, the main control device 7 controls the branch point 4 to select the branch rail 2*b* and guide the player P to the third game stage 3*c* to force the player P to challenge the easier game.

In this manner, a game corresponding to the capability of the player P is provided to him in the game stage next to the first game stage. Depending upon the control manner of the branch point 4, it is possible to provide a varied game to the player in a succeeding game stage when his score in the preceding game stage is unexpectedly low. For example, it is possible to give the player a chance of restoring his score in a preceding game stage by guiding him to a next game stage for an easier game. The game to be performed in each of the second game stage 3*b* and the third game stage 3*c* may be either a contact type game or a non-contact type game.

When the game in the second game stage 3*b* or the third game stage 3*c* is over, the result of the game is transmitted to the main control device 7 by the game control device 6*b* or 6*c* and stored in the memory of the main control device 7. After the game in the second game stage 3*b* or the third game stage 3*c* is over, the vehicle 1 enters into the main rail 2 to guide the player to the fourth game stage 3*d*.

The player P arrived at the fourth game stage 3*d* performs a contact type game with respect to the game machine 14 by using the hammer 13 as shown in FIG. 3. In this game, the vehicle 1 may be stopped or moved at a usual speed or a speed lower than the usual speed. A result of the game, that is, a score, is transmitted to the main control device 7 by the game control device 6*d* and stored in the memory of the main control device 7.

When all of the games in the first, second, third and fourth game stages are over, the main control device 7 shown in FIG. 1 collects the scores of the player in the respective game stages and outputs a total score of the player to the output device 8 as an image or a hard copy. The player P on the vehicle 1 reaches the end stage E confirms his own total score displayed on the output device As described, it is possible, in the game machine system mentioned above for performing the riding type game, to provide various games to the player P riding on the vehicle 1 by employing the riding type game machine. Further, since the game machine system includes the contact type game or games, it is possible to provide familiar games, which cannot be achieved by the non-contact type game, to the player. That is, according to the game machine mentioned above, the player P can enjoy a familiar riding type game.

Although the present invention has been described with reference to the preferred embodiments, the present invention is not limited thereto and can be variously modified by those skilled in the art within the scope of the present invention defined by the appended claims.

For example, although the branch point 4 is provided on the rail 2 in the embodiment shown in FIG. 1, the present invention is not limited thereto and can be applied to a modification in which the vehicle 1 moves along a single rail having no branch point. Further, although a single vehicle is used in FIG. 1, it is possible to arrange a plurality of vehicles on the rail.

Although, in FIG. 1, the scores in the respective game stages are collected by the main control device 7, the present invention is not limited thereto and can be applied to a game system in which the totalization of score is not performed. Further, the contact type game is not limited to that using the hammer, but may employ the game in which the player touch the target directly with his own hand.

What is claimed is:

1. A game machine system comprising:

a vehicle movable along a path and configured for having a player riding thereon, and a plurality of game stages arranged along said path, wherein at least one of said plurality of game stages is adapted to perform a contact type game in which an input operation can be performed by the player touching a target having a sensor for sensing when it is touched by the player, wherein said target moves within a region where the player can directly or indirectly physically contact said target, and wherein at least one signal output from said sensor is transmitted to a control device to be counted as a result of the game stage.

2. A game machine system as claimed in claim 1, wherein the input operation can be performed by the player hitting the target, which moves reciprocally between a hidden position and an exposed position.

3. A game machine system as claimed in claims 2, wherein said target has a predetermined figure.

4. A game system as claimed in claim 3, wherein said predetermined figure resembles a shark head.

5. A game machine system as claimed in claim 1, further comprising operation means for totalizing scores in the plurality of said game stages.

6. A game machine system as claimed in claim 1, wherein said path includes a branch point and a moving direction of said vehicle at said branch point is determined based upon a score in at least one of the plurality of game stages disposed upstream from said branch point.

7. A game machine system as claimed in claim 1, wherein said target moves parallel to a base plate on which said target is placed.

8. A game machine system as claimed in claims 7, wherein said target has a predetermined figure.

9. A game system as claimed in claim 8, wherein said predetermined figure resembles a spider.

10. A game system as claimed in claim 1, wherein said input operation can be performed by the player directly or indirectly physically contacting said target.

11. A game machine system comprising:

a vehicle movable along a path and configured for a player riding therein, a plurality of game stages arranged along said path, a branch point arranged in said path, said branch point having a plurality of branch paths for said vehicle to move and said branch point having switching means for selecting one of said branch paths for said vehicle, wherein each of said branch paths has a different type of game stage.

12. A game machine system as claimed in claim 11, wherein the difficulty of said game stages are different in degree from each other.

13. A game machine system as claimed in claim 12, further comprising a control device for controlling said branch point to select one of said game stages according to a result of at least one of the game stages which is arranged upstream from said branch point.

14. A game machine system as claimed in claim 11, further comprising a control device for controlling said branch point to select one of said game stages according to a result of at least one of the game stages which is arranged upstream from said branch point.

* * * * *